US005873669A

United States Patent [19]

Poore et al.

[11] Patent Number: 5,873,669

[45] Date of Patent: Feb. 23, 1999

[54] WIPER INSERT

[75] Inventors: Scott Poore, Simpsonville; Kevin L. Wilson, Gray Court; Barry W. Chadwick, Simpsonville, all of S.C.

[73] Assignee: BIC Corporation, Milford, Conn.

[21] Appl. No.: 850,663

[22] Filed: May 2, 1997

[51] Int. Cl.[6] ..... A46B 11/00

[52] U.S. Cl. ..... 401/122; 401/129

[58] Field of Search ..... 401/122.121, 129

[56] References Cited

U.S. PATENT DOCUMENTS

| | | | |
|---|---|---|---|
| 635,204 | 10/1899 | Taylor . | |
| 1,645,159 | 10/1927 | Russell . | |
| 3,336,624 | 8/1967 | Schefer et al. . | |
| 3,372,424 | 3/1968 | Kellett | 15/257.05 |
| 3,684,387 | 8/1972 | Glenn | 401/122 |
| 3,692,417 | 9/1972 | Aston | 401/122 |
| 3,921,650 | 11/1975 | Montgomery | 132/88.7 |
| 4,261,376 | 4/1981 | Kingsford | 401/122 X |
| 4,403,624 | 9/1983 | Montgomery | 132/88.7 |
| 4,705,053 | 11/1987 | Goncalves | 132/88.7 |
| 4,733,784 | 3/1988 | Bennett | 215/32 |
| 4,761,088 | 8/1988 | Zubek | 401/122 |
| 4,802,797 | 2/1989 | Cole | 401/122 |
| 4,810,122 | 3/1989 | Cole | 401/122 |
| 4,921,366 | 5/1990 | Hurrell | 401/126 |
| 5,141,347 | 8/1992 | Fitjer | 401/126 |
| 5,180,241 | 1/1993 | Gueret | 401/122 |
| 5,190,389 | 3/1993 | Vasas | 401/122 |
| 5,284,239 | 2/1994 | Kiricoples | 206/229 |
| 5,349,972 | 9/1994 | Dirksing et al. | 132/218 |
| 5,490,737 | 2/1996 | Gueret | 401/122 |
| 5,597,254 | 1/1997 | Vasas | 401/122 |

FOREIGN PATENT DOCUMENTS

| | | | |
|---|---|---|---|
| 149160 | 5/1951 | Australia . | |
| 0202932 | 11/1986 | European Pat. Off. . | |
| 966895 | 10/1950 | France | 401/122 |
| 1070381 | 7/1954 | France | 401/122 |
| 1436613 | 2/1985 | France . | |
| 484518 | 10/1929 | Germany | 401/122 |
| 504954 | 5/1939 | United Kingdom | 401/122 |
| 2082553 | 3/1982 | United Kingdom . | |
| WO91/01097 | 2/1991 | WIPO . | |

*Primary Examiner*—David J. Walczak
*Assistant Examiner*—Kathleen J. Prunner
*Attorney, Agent, or Firm*—Pennie & Edmonds, LLP

[57] ABSTRACT

A wiper for use in a container for liquids such as correction fluid consists of a cylindrical length of yieldable material within the neck of the container. The wiper may be formed as an insert which consists of a cylindrical body formed about a central axis and having an upper end in the form of an annular flange, with which to engage the container neck, and a lower end extending toward a reservoir within the container. From the body depend one or more cleaning elements angled toward the central axis, the ends of the elements extending beyond the lower end of the insert and defining a gap allowing for frictional passage of an applicator, and allowing removal of excess fluid from the applicator. The upper end terminates in a wiping lip upon which an applicator may be wiped to remove liquid before application. Excess liquid so removed flows through apertures provided between the cleaning elements.

21 Claims, 8 Drawing Sheets

WIPER INSERT

BACKGROUND OF THE INVENTION

1. Technical Field

The present invention concerns an improvement to containers used for liquids such as correction fluid and the like. In particular, the improvement provides a more efficient container wiper against which an applicator may be wiped to remove excess liquid, thus preventing waste of the liquid and avoiding a common problem in which the container cannot be properly sealed due to excess liquid running onto and drying on the exterior of the container.

2. Discussion of the Related Art

Liquids and semi-liquids, such as correction fluid, cosmetics, paint, and the like are often stored in containers that include a reservoir for the liquid product and an applicator brush attached to the cap of the container. When the container is closed, usually by being snugly screwed onto the container's neck, the applicator brush is submerged in the reservoir of liquid. Upon removal from the reservoir, liquid product adheres to the applicator brush. A user then applies the liquid as desired. However, if the amount of liquid withdrawn on the brush is not limited in some manner, it is frequently the case that more liquid adheres to the brush than the user actually needs. Because the liquid product is typically fast-drying, problems develop when excess liquid is removed from the container. For example, too much product may be applied, thus wasting it and possibly causing a mess. In addition, unused portions of the product will dry-out and become unusable if not promptly returned to the reservoir. The buildup of dried and unusable product on the brush makes future applications less effective. Therefore, the containers usually employ means by which excess liquid on the applicator brush can be wiped off during and/or after withdrawal of the brush from the reservoir.

The means employed is often in the form of an insert placed in the neck of the container. Such inserts are usually intended to strip the liquid from the brush as it is withdrawn from the reservoir. For example, U.S. Pat. No. 4,886,080 to Cole depicts an insert for a cosmetics container that includes at its lower, reservoir, end a "wiping orifice" to wipe cosmetics from the shaft and bristles of an applicator brush. In U.S. Pat. No. 4,761,088 to Zubek, a plurality of "tongues" protrude downward from the lower end of an insert to perform the same function.

However, not all liquid can be removed by the reservoir end of the insert because the brush must retain enough for the necessary application. Unfortunately, though, even after being wiped against the lower end of the insert, more than enough liquid for the present application often still adheres to the brush. In such an event, the user typically wipes superfluous amounts of liquid off against the inside of the upper edge of the insert. This can, however, lead to another problem if some of the liquid runs onto the exterior of the container. Inserts known in the art are not effective in preventing the liquid from running over when the brush is wiped against the upper edge of the insert. When liquid runs over the upper edge of the insert, it tends to run onto the closure threads with which the container cap must interact to create a proper seal when the container is closed. If not removed, the liquid dries in place. Over time, the buildup of excess liquid will preclude proper closure of the container, thus allowing the liquid in the reservoir to dry-out or to spill if the container is tipped over. Even if the dried excess liquid does not preclude proper closure, it generally cannot be reclaimed, thus causing additional waste.

Another disadvantage inherent in prior inserts is that users must exercise caution while re-inserting an applicator brush lest he or she accidentally brush liquid onto the exterior of the insert or neck of the container and cause additional buildup of product on the closure threads. This problem occurs because the inner diameter of the upper edge of prior art inserts is often no greater than the inner diameter of the central portion, and therefore only slightly greater than the diameter of the applicator brush used with the container.

There is thus a need in the art for means with which to remove excess liquid from an applicator brush, preclude the accumulation of dried liquid product on the exterior of the container, and provide facile re-insertion of an applicator brush.

SUMMARY OF THE INVENTION

In view of the disadvantages of the prior art, it is an object of the present invention to provide a container insert for wiping excess liquid from an applicator in such a manner as to avoid spillover of the liquid onto the exterior of the container and to thereby prevent the accumulation of dried liquid on the exterior of the container.

It is a further object of the invention to promote the flow of excess liquid wiped from an applicator back into a container reservoir.

It is a further object of the invention to provide means to guide the re-insertion of an applicator into a container.

It is a still further object of the invention to prevent excessive buildup of dried or unusable liquid on an applicator by providing means for excess liquid to be wiped from the brush as it is withdrawn from the container reservoir.

In a wiper insert according to the present invention, a cylindrical wiper insert is provided that includes multiple cleaning prongs at its lower, or reservoir, end for initial wiping of excess liquid as an applicator is withdrawn from the reservoir. The prongs extend from the inner wall of the insert obliquely downward toward the central axis of the insert. The lower ends of the prongs preferably do not meet, but are instead separated by a gap, smaller in diameter than that of an applicator, through which the applicator passes. Because the gap is smaller than the applicator, the prongs strip liquid from the applicator as it passes through the gap. The upper ends of the prongs are separated by apertures through which excess liquid can pass into the reservoir.

The insert further includes an upper end formed into an annular flange, centered about the central axis of the insert, which terminates in a lip extending substantially completely about the circumference of the upper edge. The lip joins the inner and outer circumferences of the flange, the inner circumference of which is defined by a sloping wall. An applicator may be wiped against the lip in order to remove excess liquid. The lip directs the wiped-off excess liquid away from the exterior of the insert, down the sloping inner circumference of the flange, and down the inner wall of the insert toward the reservoir.

The inner diameter of the upper end of the insert is greater than the inner diameter of the central portion of the insert, thus promoting easy re-insertion of an applicator.

BRIEF DESCRIPTION OF THE DRAWINGS

These and other features, aspects, and advantages of the present invention will become more readily apparent from the following detailed description, which should be read in conjunction with the accompanying drawings, in which.

DETAILED DESCRIPTION OF THE INVENTION

Figure 1:
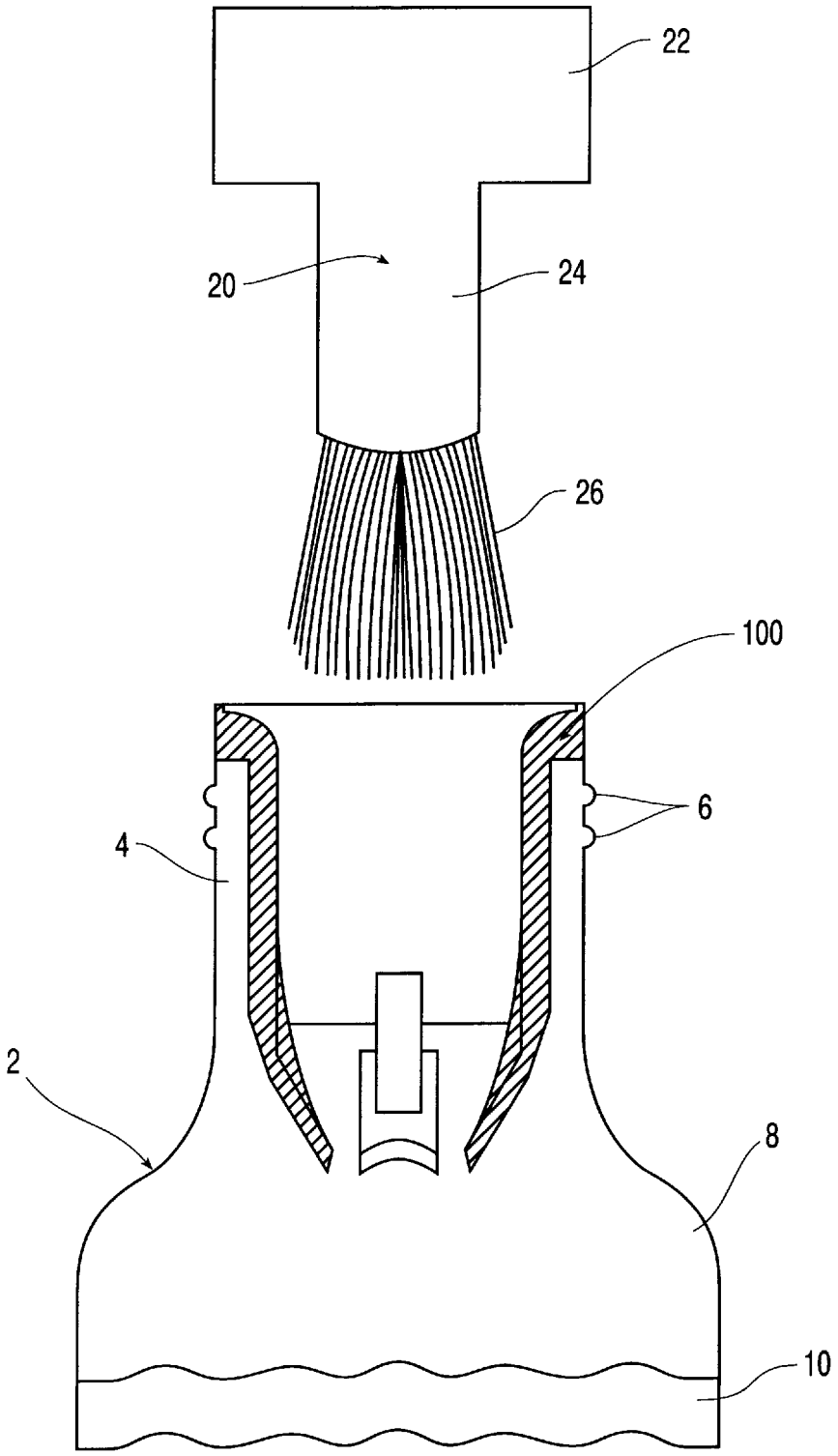
FIG. 1 depicts a partial cross-section of a container, in an open configuration, with an application, in which one embodiment of the invention is installed.

The following embodiments will be described in the context of a correction fluid container. Those skilled in the art, however, will recognize that the disclosed structures are readily adaptable for broader applications. Note that whenever the same reference numeral is repeated with respect to different figures, it refers to the corresponding structure in each figure.

With reference to FIG. 1, an illustrative embodiment of wiper insert 100 is situated securely in place in neck 4 of container 2. Insert 100 is formed of a yieldable material, such as polyethylene or the like, and is generally cylindrical in shape. The lower portion of container 2 forms reservoir 8, in which correction fluid 10 is stored. Applicator 20 is affixed to container cap 22 and comprises shaft 24 and bristles 26. In place of bristles, some other material which can convey correction fluid 10, such as various foams, may be used.

Figure 2:
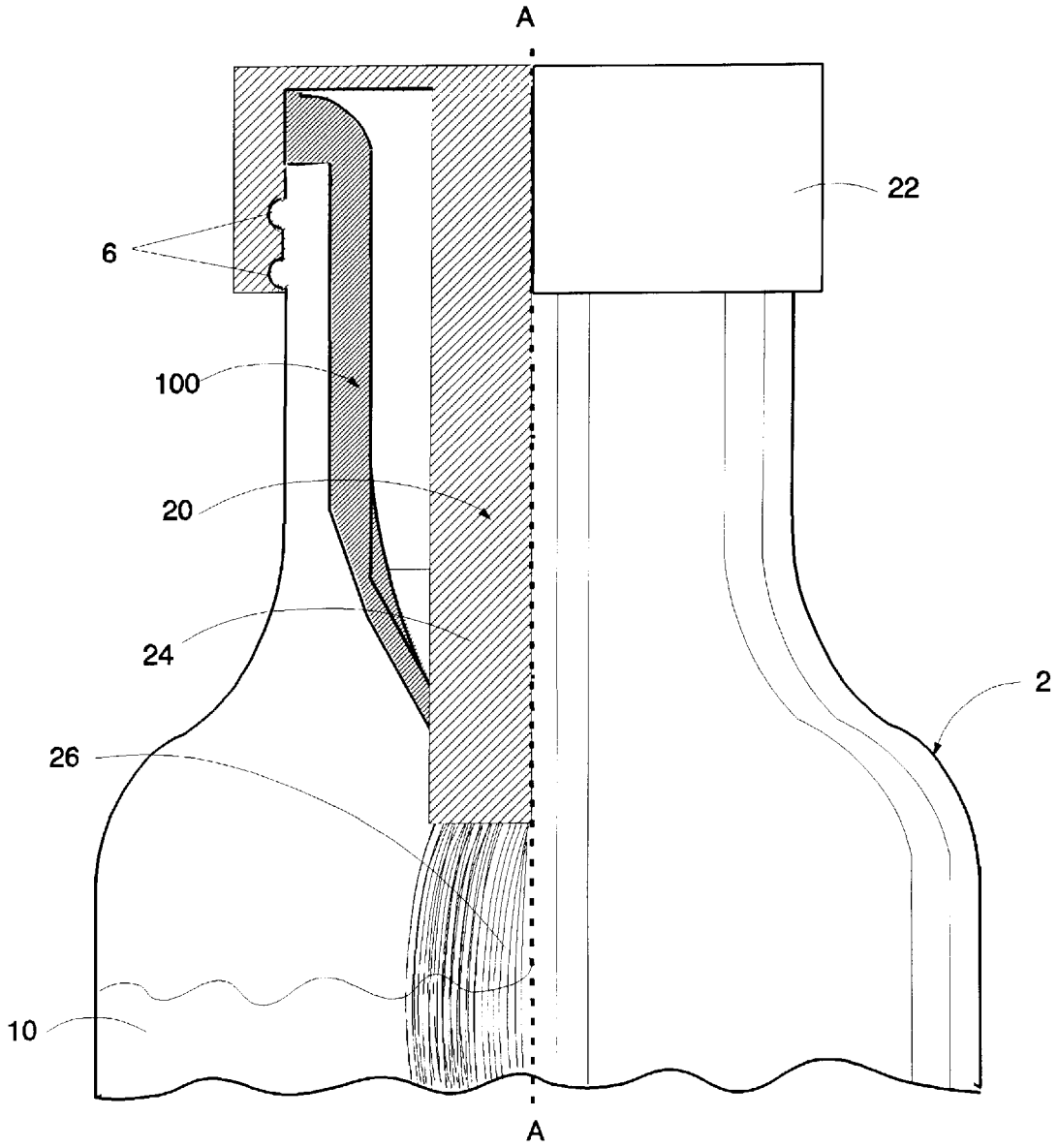
FIG. 2 depicts a partial cross-section of a container in a closed configuration, with one embodiment of the invention installed.

When container 2 is closed, as depicted in FIG. 2, bristles 26 are immersed in correction fluid 10 and cap 22 releasably interlocks with threads 6 on the exterior of neck 4.

Figure 3A:
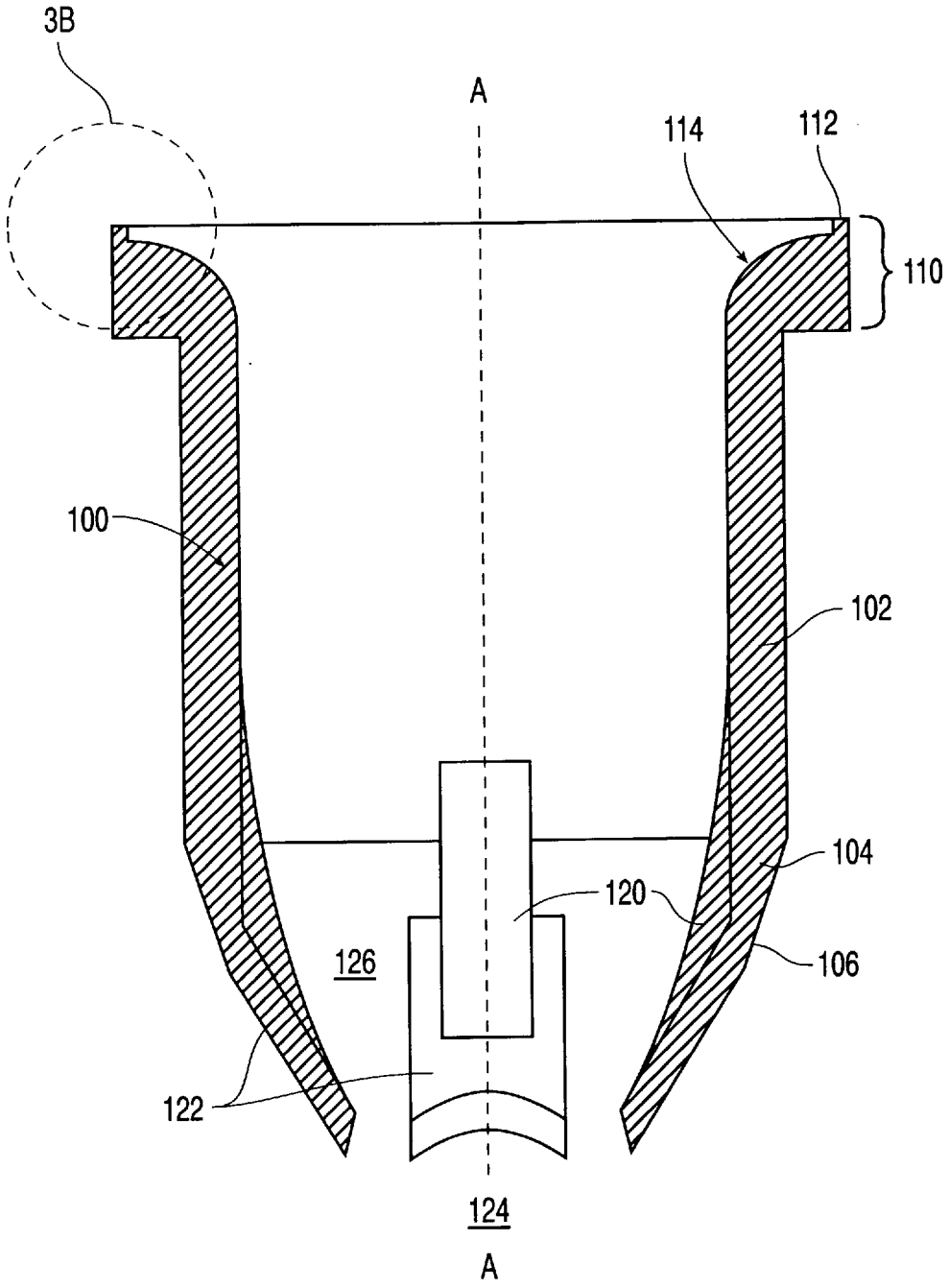
FIG. 3A is a longitudinal cross-section of one embodiment of the present invention.
Figure 3B:
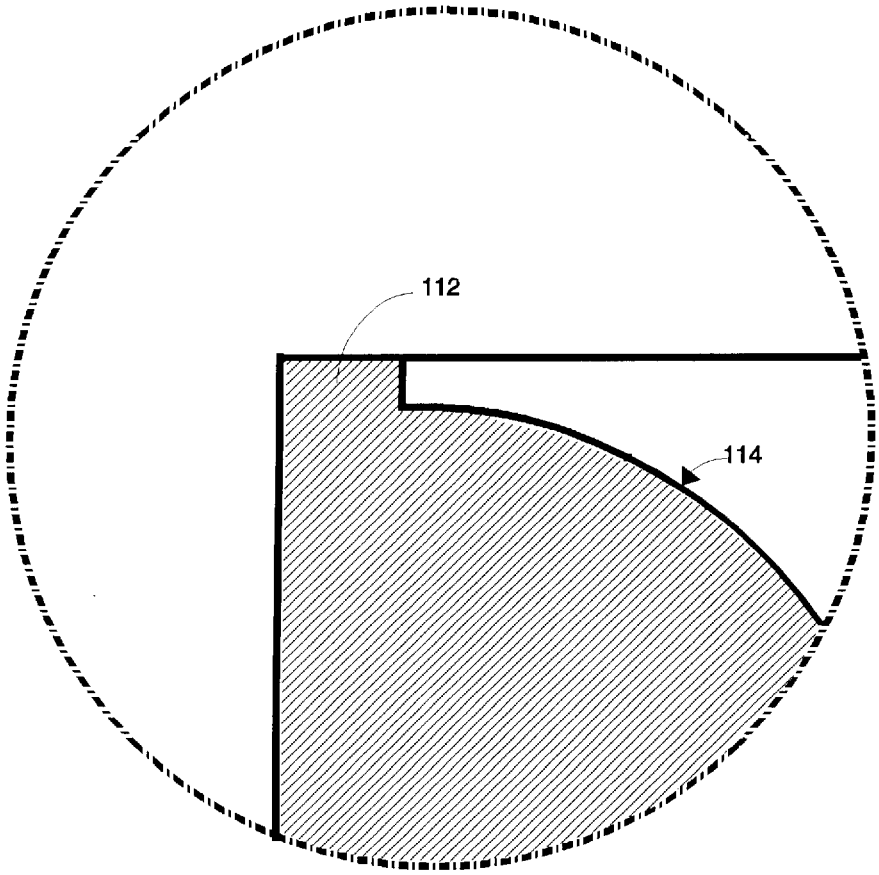
FIG. 3B is an expanded view of the lip at the upper end of the embodiment featured in FIG. 3A, as indicated by 3B.
Figure 3C:
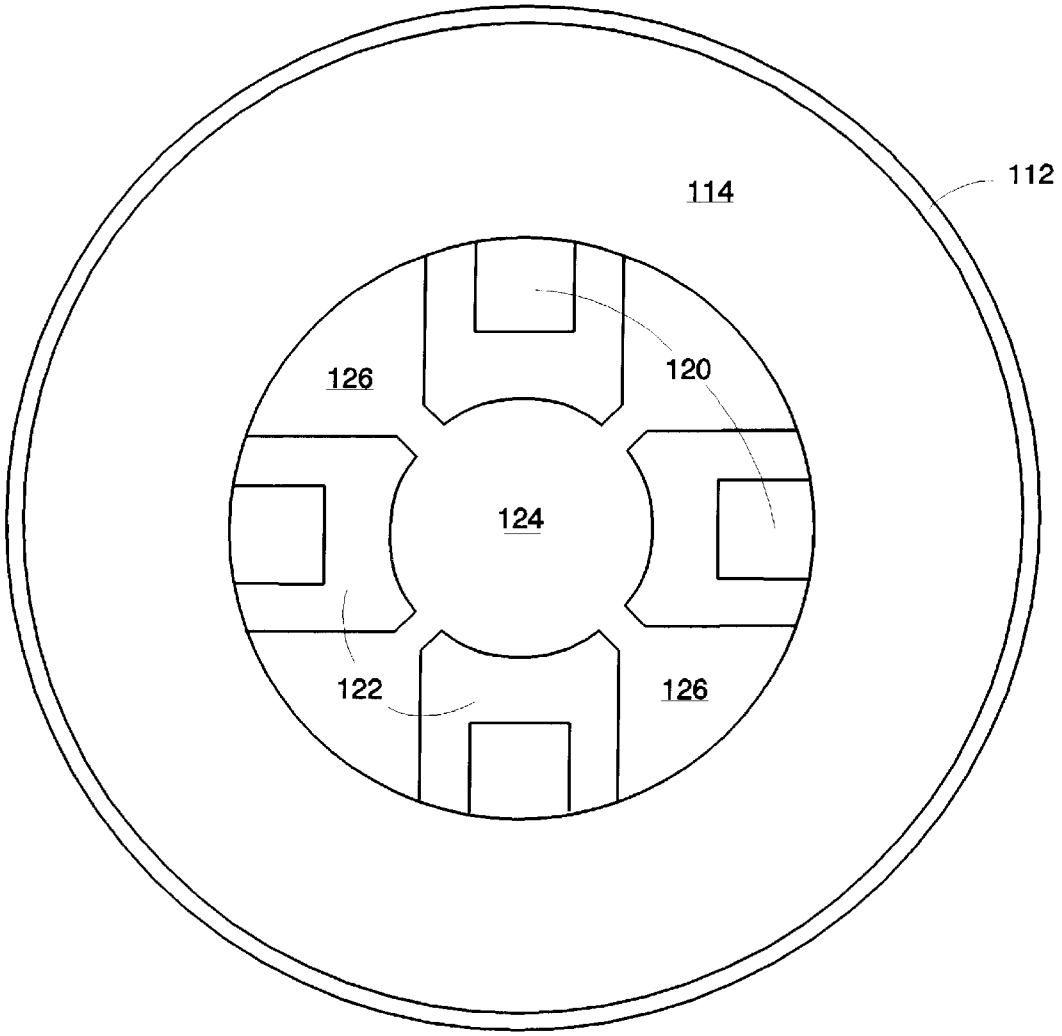
FIG. 3C is a top view of the embodiment of the invention depicted in FIG. 3A.

With reference now to FIGS. 3A, 3B, and 3C it can be seen that insert 100 is generally cylindrical in shape about a central axis A. Wall 102 is substantially parallel to axis A along a central portion of insert 100.

The lower end of insert 100 includes the bottom of wall 102, which is marked by bevel 104. The lower end of insert 100 also includes a plurality of, illustratively four, prong-shaped cleaning elements 120, arranged about central axis A, and made of a flexible and resilient material such as, for example, polyethylene. Prongs 120 are connected to and depend from the interior of wall 102 and extend obliquely inward and downward toward axis A. The prongs terminate below edge 106 of bevel 104, but short of axis A. Lower ends 122 of prongs 120 are wider than the upper ends. The lower ends 122, in one illustrative embodiment, do not connect to each other, but instead form a broken ring to define a circular gap 124 through which applicator 20 passes (best shown in FIG. 3C). It will be understood by one of skill in the art that gap 124 may be other than circular in appearance, depending upon the cross-sectional shape of applicator 20 and/or the pattern in which excess correction fluid is to be wiped from the applicator.

Gap 124 allows passage of bristles 26 and shaft 24 of applicator 20. During insertion of applicator 20, prongs 120 are spread apart outward and away from axis A. When applicator 20 is withdrawn from reservoir 8, it necessarily wipes against prongs 120, thus removing an initial amount of excess liquid. The flexible rigidity of prongs 120 allow them to penetrate into applicator 20 (between the bristles in the case of a brush), thus removing excess correction fluid and preventing the accumulation and compaction of fluid in the applicator. If not removed, accumulated unusable fluid decreases the effectiveness of applicator 20 by decreasing the amount of usable fluid that can be transported and applied thereby. Between prongs 120 are open spaces 126 through which excess liquid may drain into reservoir 8. Spaces 126 are wedge-like in shape when viewed from above, wider at the upper portions of prongs 120 and tapering toward lower portions 122. Thus, prongs 120 form an open and broken circle about the central axis and are separated from each other by sectional apertures formed by spaces 126. As described below, when additional fluid is wiped off applicator 20 against the upper end of insert 100, the excess fluid flows down wall 102 and through spaces 126.

Figure 4A:
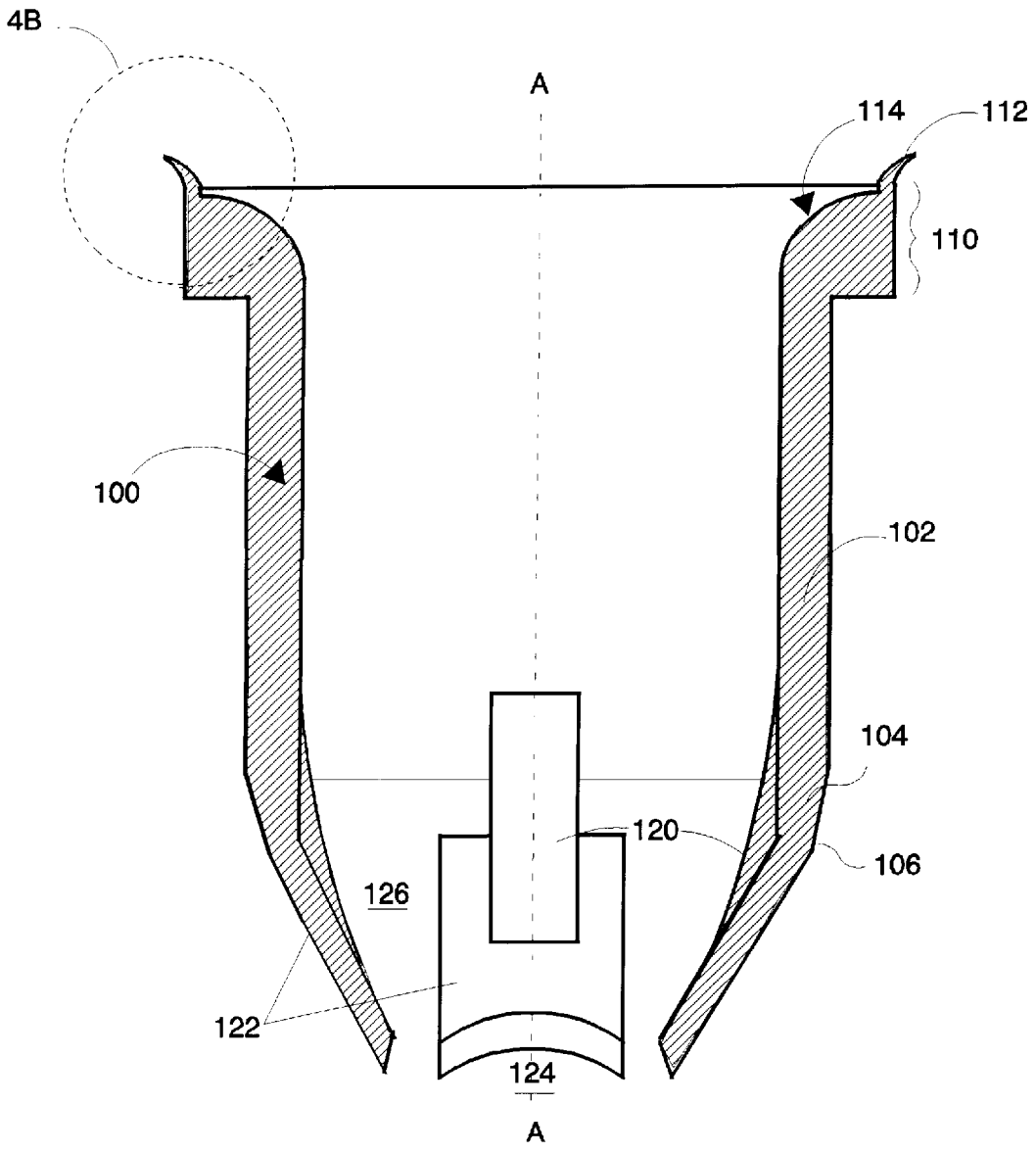
FIG. 4A is a longitudinal cross-section of an alternative embodiment of the invention.
Figure 4B:
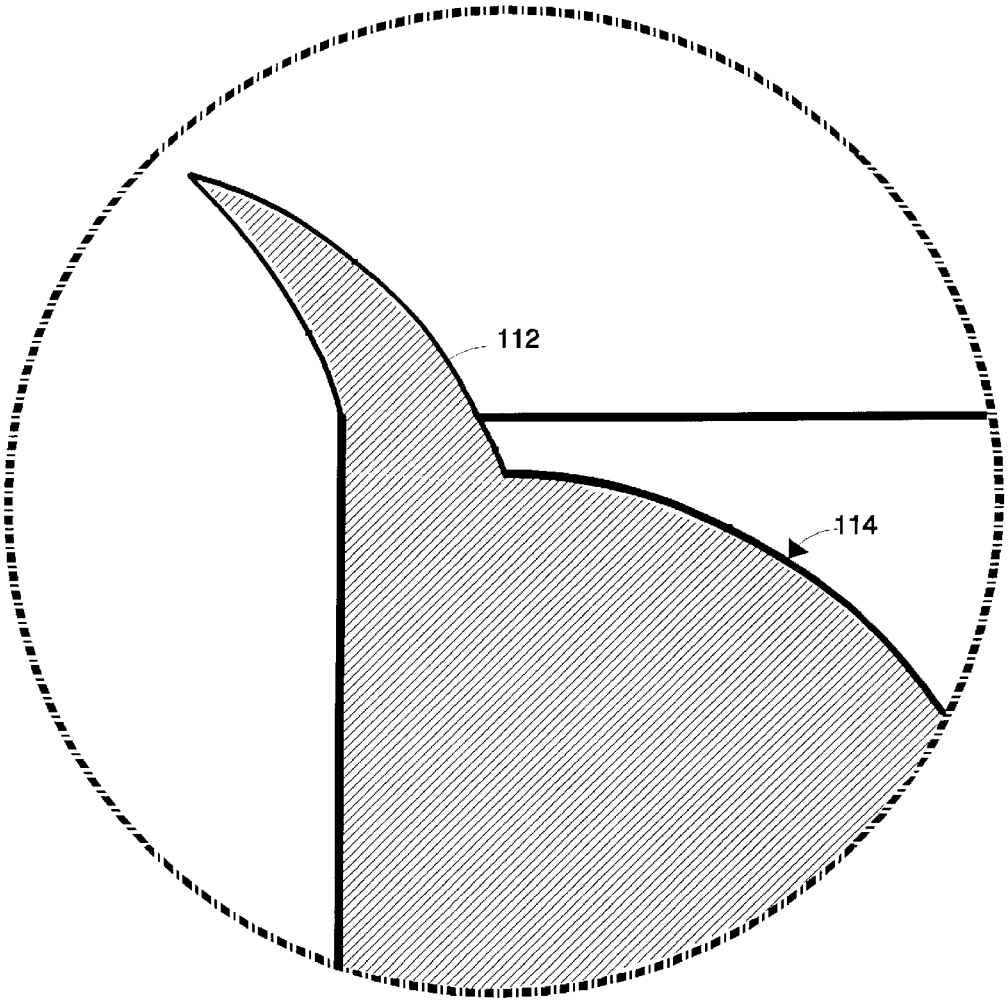
FIG. 4B is an expanded view of the lip at the upper end of the embodiment featured in FIG. 4A, as indicated by 4B.

The upper portion of insert 100 forms peripheral annular flange 110 which engages and seats against the top of neck 4 of container 2, as shown in FIGS. 1 and 2. Lip 112 is in the form of a protruding structure extending upward from flange 110, preferably either substantially parallel to or angled away from central axis A. In an illustrative embodiment, depicted in FIGS. 3A and 3B, lip 112 is substantially perpendicular to flange 110 and parallel to central axis A. In an alternative embodiment, depicted in FIGS. 4A and 4B, lip 112 extends curvedly upward and outward from axis A at approximately a 45° angle. As may be appreciated with reference to FIG. 4B, the curved upward and outward shape of 112 causes at least a portion of the outer surface of flange 110 to be substantially concave.

Even after scraping against cleaning prongs 120, as it is withdrawn from reservoir 8, applicator 20 may contain more correction fluid than the user needs. The purpose of lip 112 is to provide an edge against which applicator 20 can be wiped to remove this excess fluid. Lip 112 directs the wiped off fluid toward the interior of insert 100 rather than allowing it to run over to container threads 6.

Inwardly sloping inner circumference 114 slopes from a wider dimension proximate to lip 112 toward a narrower dimension where it meets the interior of wall 102. Circumference 114 defines the inner circumference of flange 110 and directs excess liquid from lip 112 toward the central portion of insert 100 and reservoir 8. The inner diameters of lip 112 and the top of circumference 114 are greater than the inner diameter of the central portion of insert 100. In an illustrative embodiment, circumference 114 presents a convex appearance when viewed cross-sectionally. Thus, upon re-insertion of applicator 20 into container 2, the applicator is guided toward central axis A and wall 102 by circumference 114, then, at wall 102, downward and substantially parallel to central axis A, until it passes between prongs 120.

Figure 5:
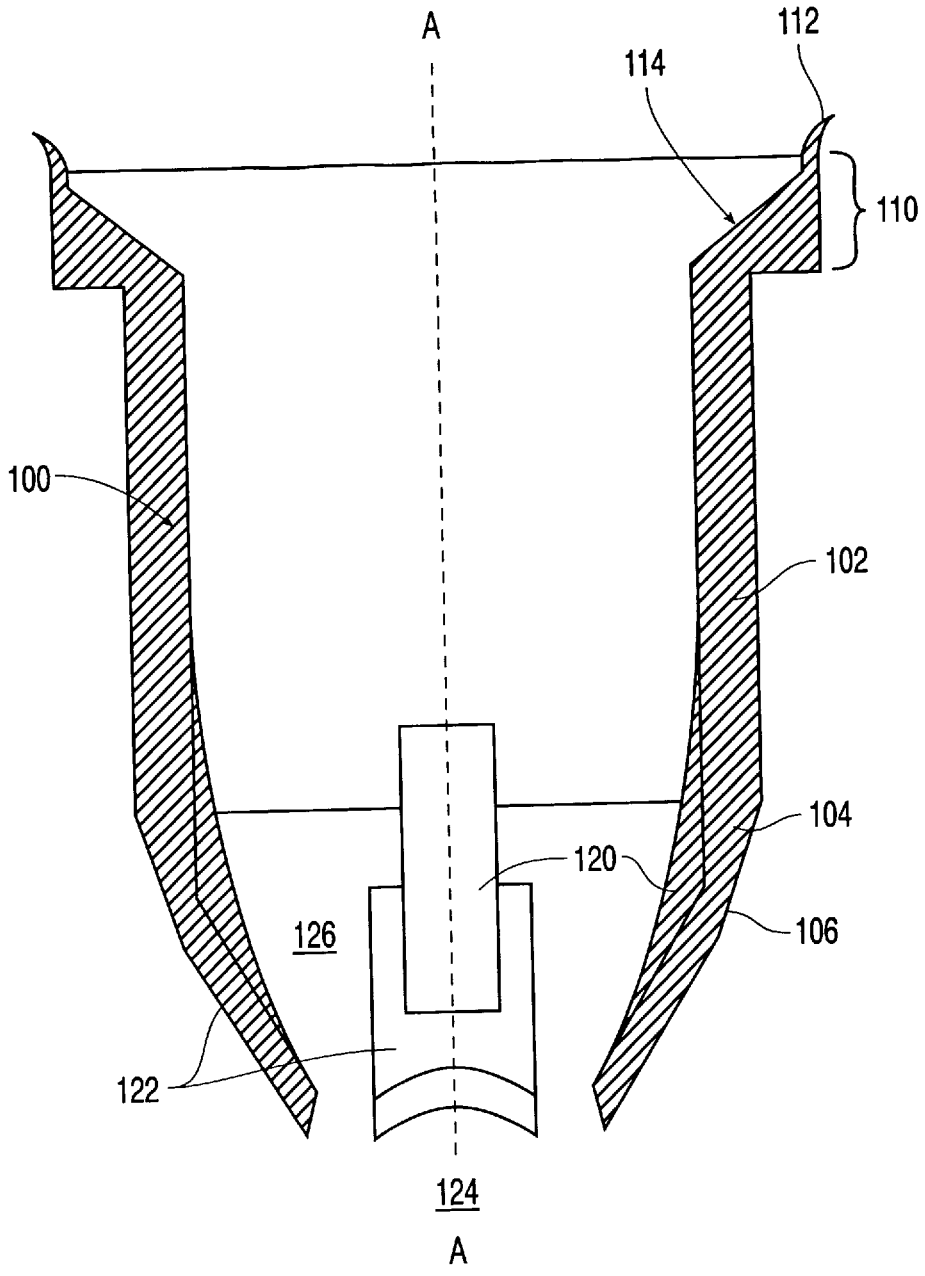
FIG. 5 is a longitudinal cross-section of another alternative embodiment of the invention.

The above description is intended to be illustrative, not limitative. Thus, it will be apparent to those skilled in the art that modifications may be made to the invention as described without departing from the scope of the claims set out below. For example, sloping circumference 114 need not be convex in appearance. Alternatively, it could form a linear slope from lip 112 to the interior of wall 102, as shown in FIG. 5.

We claim:

1. A wiper insert for a container for the storage of a fluid, said wiper insert being formed of a cylindrical length of yieldable material around a central axis and comprising:

a body portion possessing a body portion inner diameter and a body portion outer diameter;

a distal end portion at one end of said body portion; and a proximal end portion at an opposite end of said body portion, said proximal end portion forming an annular flange about said central axis and comprising:

an inner surface having a first end with a first inner diameter equal to said body portion inner diameter at the junction of said inner surface with said body portion and having a second end with a second inner diameter exceeding said first inner diameter;

an outer surface having an outer diameter exceeding said body portion outer diameter; and a lip disposed between said inner surface second inner diameter and said outer surface;

wherein:

said lip is in the form of a protruding structure extending upward from said inner surface to direct fluid wiped on said lip inward; and said inner surface slopes inwardly from said lip at said second inner diameter to said body portion at said first inner diameter to direct liquid from said lip inward.

2. The apparatus of claim 1, wherein said lip extends upward, substantially parallel to said central axis.

3. The apparatus of claim 1, wherein said lip extends outward from said central axis at an angle of approximately 45°.

4. The apparatus of claim 1, wherein said outer surface of said annular flange is substantially vertical.

5. The apparatus of claim 1, wherein said outer surface of said annular flange is substantially concave.

6. The apparatus of claim 1, wherein said inner surface of said annular flange convexly slopes from said lip to said body portion.

7. The apparatus of claim 1, wherein said inner surface of said annular flange linearly slopes from said lip to said body portion.

8. The apparatus of claim 1, further comprising at least one cleaning element connected to said body portion and shaped to wipe excess fluid off an applicator withdrawn through said wiper insert.

9. The apparatus of claim 8, wherein said at least one cleaning element comprises a plurality of cleaning elements in the shape of prongs having upper ends connected to said body portion and lower ends extending below said body portion, opposed, lower ends of said prongs forming an open and broken circle about the central axis.

10. The apparatus of claim 9, wherein said prongs are separated from each other by sectional apertures.

11. The apparatus of claim 8, comprising at least four cleaning elements.

12. The apparatus of claim 8, wherein said at least one cleaning element comprises a plurality of cleaning elements angling inward from said body portion at an obtuse angle and converging toward the central axis.

13. The apparatus of claim 1, wherein said lip extends curvedly upward and outward from the central axis.

14. An insert for a container having a reservoir for the storage of a fluid and a neck, the fluid being removed from the container and applied via an applicator, said insert having a central axis and fitting into and seating upon the neck of the container, said insert comprising:

an annular flange portion engaging and seating around the neck of the container and comprising an uppermost end having a first inner diameter and a lowermost end having a second inner diameter smaller than said first inner diameter, said flange portion inwardly sloping from said first inner diameter to said second inner diameter; and a wiping lip at said first inner diameter and protruding upward from said flange for removing excess fluid from the applicator and guiding the fluid away from the exterior of the container so that the fluid does not remain on said insert.

15. The insert of claim 14, wherein said wiping lip further comprises:

an inner terminus, with an associated first elevation above said flange portion; and an outer terminus, greater in distance from the central axis than said inner terminus and having an associated second elevation above said flange portion;

wherein said second elevation is not less than said first elevation.

16. The insert according to claim 14, further comprising:

a cylindrical body portion disposed about said central axis and joining said flange portion, said cylindrical body portion having an inner diameter substantially equal to said second inner diameter of said flange portion; and a plurality of yieldable cleaning prongs extending inwardly and downwardly from said body portion and toward the central axis, said cleaning prongs having lower ends forming an open ring smaller in diameter than the applicator.

17. A container for the storage of a fluid and adapted to be used with an applicator inserted through a container opening, said container comprising:

a reservoir portion for containing fluid; and a neck portion defining an opening to said reservoir portion, said opening being formed around a central axis, said neck portion including a wiper disposed annularly around said opening and central axis, wherein said wiper comprises:

an upper opening portion defining said opening to the outside of said container and having a first inner diameter sloping inward and downward to a second inner diameter smaller than said first inner diameter;

an annular wiping lip in the form of a protruding structure extending upward from and surrounding said upper opening portion at said first inner diameter of said upper portion, said wiping lip and said upper portion being shaped to direct excess fluid wiped onto said wiping lip into said reservoir so that fluid does not remain on said insert; and an inner portion disposed below the upper portion, said inner portion including an annular wall shaped for removing excess liquid from the applicator passed therethrough.

18. The container according to claim 17, wherein said wiper upper opening portion and said inner portion are joined by a substantially cylindrical body portion having an inner diameter at least substantially the same as said second inner diameter.

19. The container according to claim 17, wherein said inner portion has an inner diameter substantially the same as said second inner diameter of said upper opening portion.

20. The container according to claim 17, wherein said wiper upper opening portion forms a wall having an inwardly directed convex curvature where transitioning from said first inner diameter to said second inner diameter.

21. The container according to claim 17, wherein said wiper is formed separately from said container and inserted into said neck portion.

* * * * *